US007150580B1

(12) United States Patent
Ess

(10) Patent No.: US 7,150,580 B1
(45) Date of Patent: Dec. 19, 2006

(54) TAPERED MANHOLE SEALING BAND AND METHOD FOR USE

(76) Inventor: Paul H. Ess, 5542 Vinewood La. North, Plymouth, MN (US) 55442

( * ) Notice: Subject to any disclaimer, the term of this patent is extended or adjusted under 35 U.S.C. 154(b) by 0 days.

(21) Appl. No.: 11/210,594

(22) Filed: Aug. 24, 2005

(51) Int. Cl.
*E02D 29/14* (2006.01)

(52) U.S. Cl. ..... 404/26; 404/25; 52/20; 277/602

(58) Field of Classification Search ..... 404/25, 404/26; 277/602, 608, 616, 625, 626; 52/20
See application file for complete search history.

(56) References Cited

U.S. PATENT DOCUMENTS 3,958,313 A * 5/1976 Rossborough ..... 29/890.14
4,103,901 A * 8/1978 Ditcher ..... 277/606
4,305,679 A * 12/1981 Modi ..... 404/25
4,325,572 A 4/1982 Arntyr et al.
4,387,900 A * 6/1983 Ditcher et al. ..... 29/235
4,469,467 A * 9/1984 Odill et al. ..... 404/25
4,475,845 A * 10/1984 Odill et al. ..... 404/25
4,557,625 A * 12/1985 Jahnke et al. ..... 404/25
4,711,455 A * 12/1987 Ditcher et al. ..... 277/616
4,737,220 A * 4/1988 Ditcher et al. ..... 156/218
4,746,127 A * 5/1988 Westhoff et al. ..... 277/314
4,793,387 A * 12/1988 LeBlanc et al. ..... 141/86
4,890,863 A * 1/1990 Westhoff et al. ..... 277/606
4,903,970 A * 2/1990 Ditcher et al. ..... 29/235
4,955,641 A * 9/1990 Dent ..... 285/96
5,021,261 A * 6/1991 Bowman ..... 427/286
5,032,197 A * 7/1991 Trimble ..... 156/71
5,046,886 A * 9/1991 Muir et al. ..... 404/25
5,388,868 A * 2/1995 Burkit ..... 285/148.26
5,398,979 A 3/1995 Longpré et al.
5,431,553 A * 7/1995 Topf, Jr. ..... 425/11
5,496,128 A * 3/1996 Odill ..... 404/25
5,511,897 A * 4/1996 House et al. ..... 404/25
5,531,485 A * 7/1996 House et al. ..... 285/230
5,613,806 A * 3/1997 House et al. ..... 405/150.1
5,800,648 A * 9/1998 House et al. ..... 156/71
5,876,039 A * 3/1999 Skinner et al. ..... 277/617
5,876,533 A * 3/1999 House et al. ..... 156/71

OTHER PUBLICATIONS

Sealing Systems, Inc., Infi-Shield® Uniband Installation Procedures, pp. 1-2, undated.
NeeNah Foundry Co., Product Catalog, pp. 32-33, Mar. 22, 2005.
Tech Data, Cretex Specialty Products, *External Manhole Chimney Seal*, pp. 1-4, dated Sep. 1998.
SurSeal, Mar Mac, *An External Manhole Frame/Chimney Seal*, pp. 1-2, undated.
Adaptor Inc., *Internal/External Adaptor Seal*, pp. 1-4, undated.
Adaptor Inc., *Internal/External Adaptor Seal Specification*, 1 page, undated.

* cited by examiner

*Primary Examiner*—Gary S. Hartmann

(57) ABSTRACT

The invention relates to a device and method for sealing a manhole structure. An elastomeric band with at least two different peripheries is sealingly engaged to at least two corresponding peripheries of the manhole structure. Adhesives and supplemental retaining bands may also be used to secure the elastomeric band to the manhole structure.

17 Claims, 3 Drawing Sheets

TAPERED MANHOLE SEALING BAND AND METHOD FOR USE

FIELD OF THE INVENTION

This invention relates to manhole sealing devices and methods. In particular, it relates to a method and device for applying a tapered seal to a manhole structure with at least two peripheral dimensions.

BACKGROUND OF THE INVENTION

Manholes are used to provide street-level access to sewer lines and other underground structures. Most often, the top portion of the manhole has the form of a cylindrical frame with a lid. The lower portion of the frame, which is not generally seen after installation, often resembles a hat with a brim that rests on a concrete cone leading to a sewer. The upper portion of the frame holds a lid. The elevation of the manhole frame and lid may be raised to the level of the surrounding surface grade by placing one or more concrete adjusting rings between the bottom of the frame and the cone. A manhole structure is thus created by stacking a number of components on top of each other. After the manhole structure is installed, the space around it is filled in so that only the lid at the top portion of the manhole frame is conveniently accessible at street-level.

Manholes created by such stacking of components are vulnerable to leaks. Water and other contaminants may enter the manhole through gaps between the stacked components after installation. Once the manhole structure has been installed and the earth around it filled in, gaps below the ground level become difficult to reach. It is thus desirable to seal the manhole structure during installation to prevent further leaks at the interfaces between the stacked components.

Various methods and devices are known for sealing the external surfaces of manhole structures. One method employs an elastomeric band positioned around the top portion of the cone and extending over the adjusting rings to the base of the manhole frame. Because the cone and the adjusting rings have generally the same outer perimeter, a single sealing band may be used to provide a seal for the gaps between these components. Although such a method provides an adequate seal for the portions of the manhole structure with a periphery corresponding to the band's periphery, i.e., lower portion of the manhole structure from the cone to the bottom of the frame, they do not adequately seal the upper portion of the frame, which has a periphery that is generally narrower than the periphery of the manhole frame's base.

Manhole structures, however, often have structural gaps in the region between the two peripheries where conventional sealing bands do not reach. For example, some manhole-frame designs have holes in the horizontal portion of the frame base that are used to retain bolts or anchors for securing the frame to the stacked components below it. Another example is the "floating" casting. A floating casting is a two-piece manhole frame with a narrower upper frame resting on a wider base flange. For such manhole frames, and for other manhole frame designs with similar leakage points, existing methods are inadequate to provide a complete seal. It is thus desirable to extend the seal from the larger outer periphery generally shared by the cone and adjusting rings to the narrower periphery of the upper frame and lid.

What is needed in the industry is a device and method for better sealing a manhole structure that can seal both the larger lower external periphery of a manhole structure and any potential leaks that may originate between the lower periphery of the manhole structure and the narrower periphery of the upper portion of the manhole frame and lid.

SUMMARY OF THE INVENTION

The problems outline above are in large part solved by the present invention. In particular, the resilient band of the present invention may be used to provide a seal extending from the lower larger external periphery of a manhole structure up to the smaller upper periphery of the manhole frame. The sealing band has a first portion that fits around the first larger periphery of the manhole structure. A second tapered portion of the band extends from the first portion to the second smaller periphery of the manhole frame.

DETAILED DESCRIPTION

Figure 1:
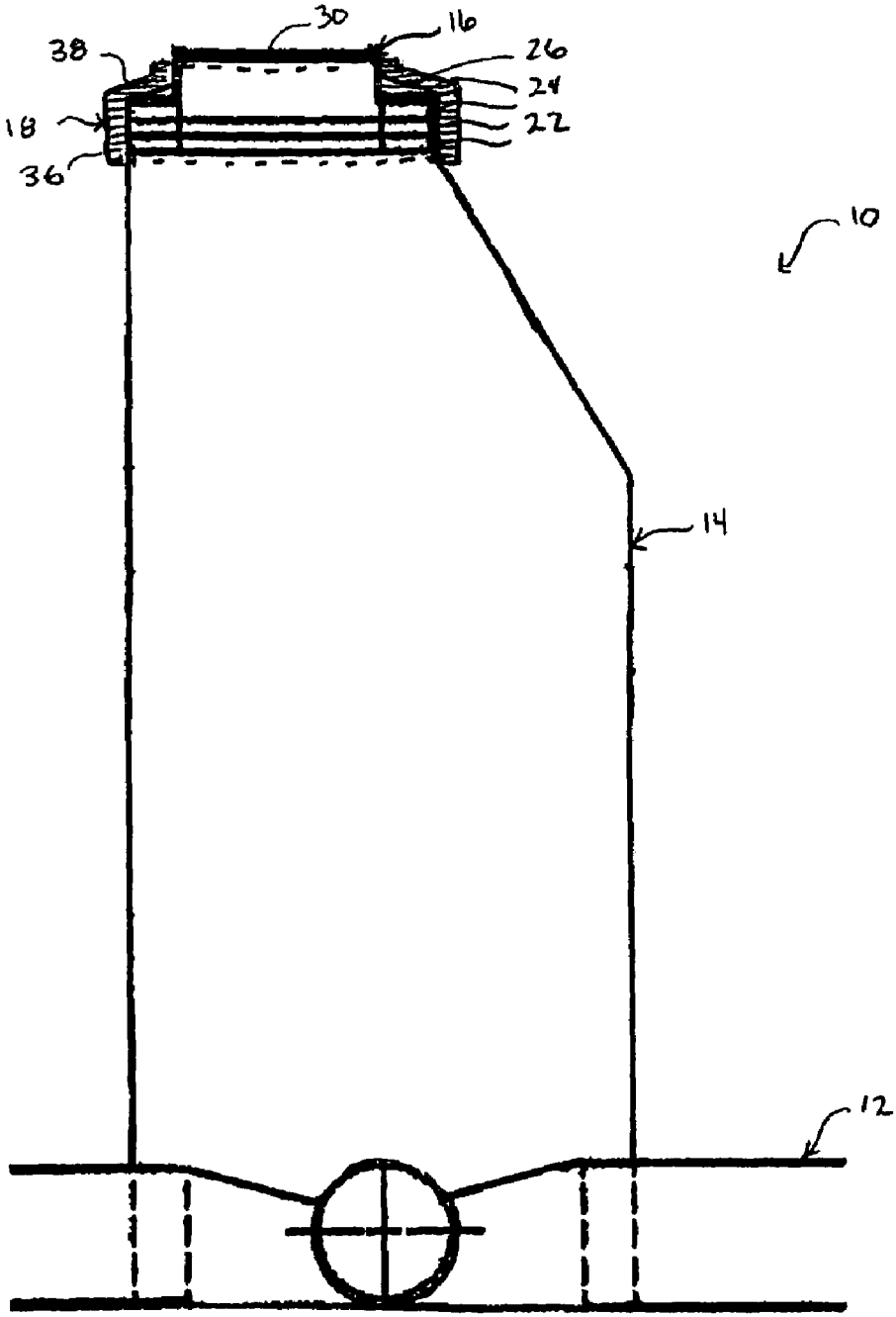
FIG. 1 is an elevational view of a manhole structure with the manhole frame shown in cross section and with phantom lines depicting the intersection of the manhole structure with a sewer.

FIG. 1 depicts a manhole structure 10 made up of vertically stacked components connected to a sewer 12. The stacked components include a cone 14, adjusting rings 22, and frame 16. Cone 14, at the bottom of manhole structure 10, is connected directly to sewer 12. Adjusting rings 22 rest on the top of cone 14. Frame 16 rests on adjusting rings 22. Frame 16 has a base portion 24 and an upper portion 26 and supports a lid 30.

A resilient band 18 in accordance with the invention is positioned around the upper portion of the manhole structure 10. The resilient band 18 covers the top of cone 14, adjusting rings 22, and part of frame 16. The resilient band 18 includes a first portion 36 and a second tapered portion 38. The first portion 36 of resilient band 18 is secured around a periphery of the manhole structure 10 defined by the upper portion of cone 14, the adjusting rings 22, and the lower portion of frame 16. The second portion 38 of resilient band 18 extends from the first portion 36 and surrounds the manhole structure 10 from the base portion 24 of frame 16 to the upper portion 26 of frame 16. Second portion 38 of resilient band 18 tapers, becoming narrower until it reaches the narrower periphery of the upper portion 26 of frame 16 of manhole structure 10. Second portion 38 is secured around manhole structure 10 at the upper portion 26 of frame 16 of manhole structure 10.

Figure 2:
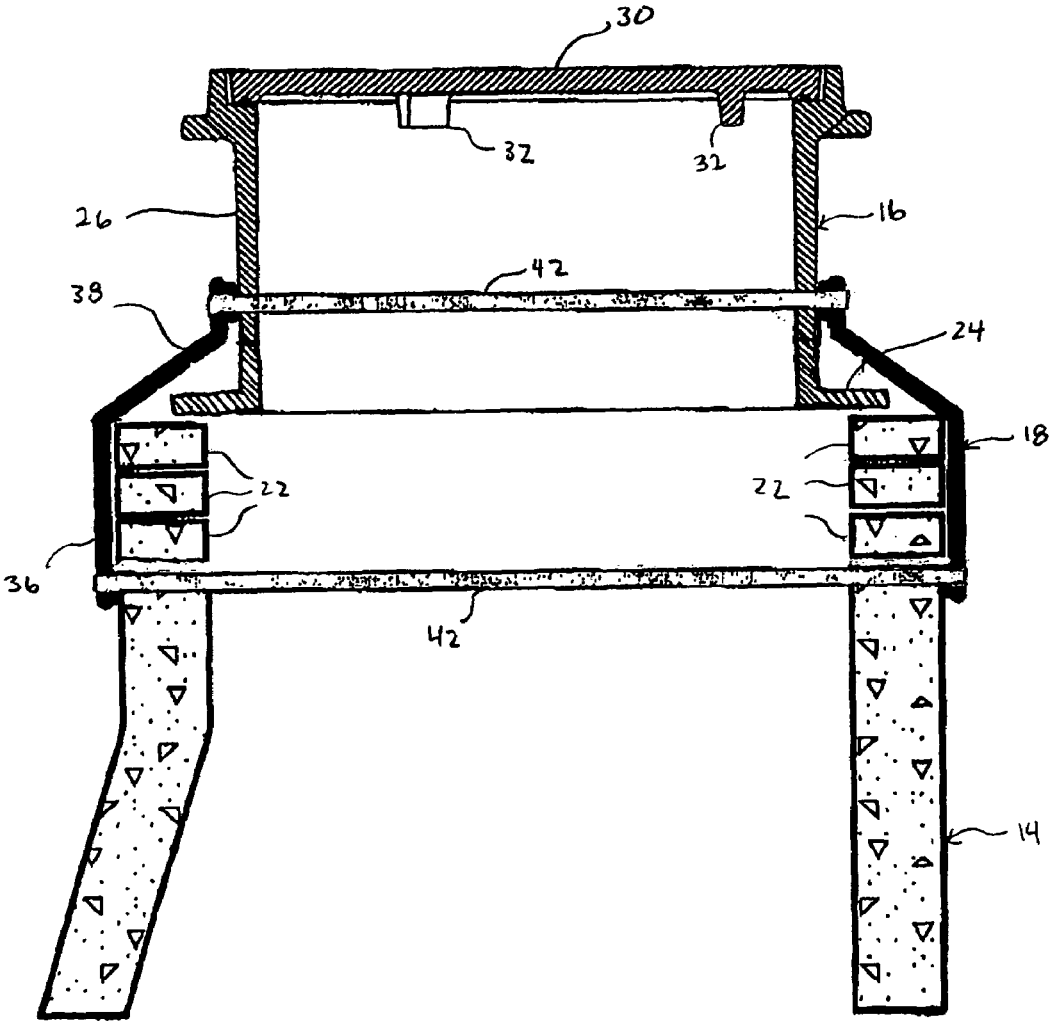
FIG. 2 is a fragmentary cross section of a view of the invention in place on a manhole structure.
Figure 3:
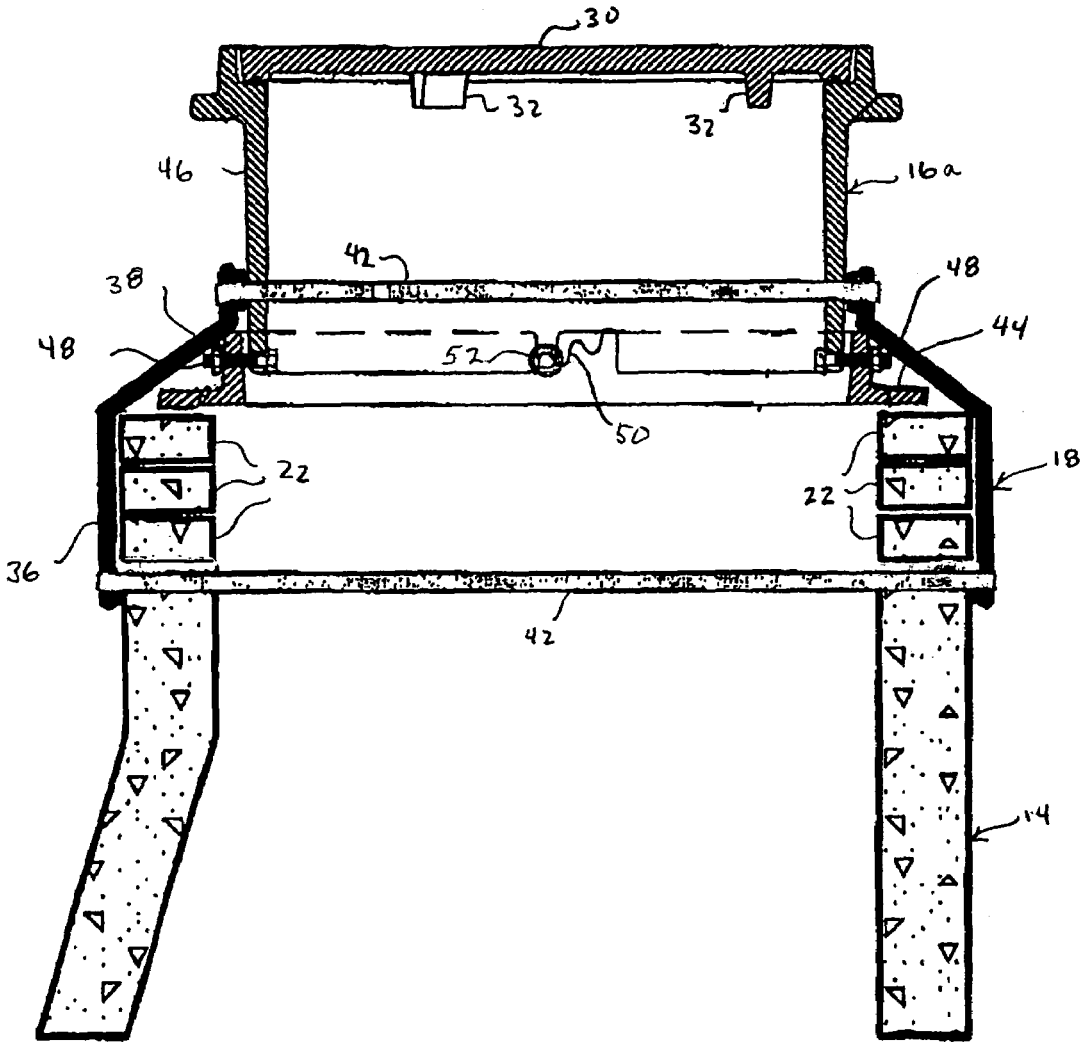
FIG. 3 is a fragmentary cross section of the invention in place on an alternative manhole structure.

FIGS. 2 and 3 depict in greater detail the resilient band 18 fitted to different kinds of manhole frames.

FIG. 2 depicts resilient band 18 in place over frame 16. Frame 16 has a base portion 24 and an upper portion 26. Adjusting rings 22 at the top of cone 14 support one-piece frame 16. The base portion 24 has a larger periphery than upper portion 26. A lid 30 with drop handles 32 rests on upper portion 26.

As shown in FIG. 2, resilient band 18 has a first portion 36 and a second tapered portion 38. The first portion 36 is attached to a periphery defined by the upper portion of cone 14 and the adjusting rings 22. The second tapered portion 38 of resilient band 18 extends upward from the first portion 36 and surrounds varying peripheries of manhole structure 10 including the top of adjusting rings 22 and the base and upper portions 24, 26 of frame 16. The second tapered portion 38 of resilient band 18 is attached to the periphery of the upper portion 26 of frame 16.

FIG. 2 also shows two supplemental retaining bands 42 over resilient band 18. One supplemental retaining band 42 surrounds the resilient band 18 at the top of cone 14 below adjusting rings 22. Another retaining band 42 surrounds the resilient band 18 at the upper portion 26 of frame 16.

FIG. 3 shows retaining band 18 positioned around a two-piece manhole frame 16*a*. The lower portion of frame 16*a* includes a flange 44 with engagement member 46 and fasteners 48. Fasteners 48 engage the upper portion 46 of frame 16*a*. The first portion 36 of resilient band 18 is attached to the periphery defined by the upper portion of cone 14 and the adjusting rings 22. The second portion 38 of resilient band 18 surrounds the region including adjust rings 22, flange 44, and upper portion 46 of two-piece frame 16*a*. The second portion 40 of resilient band 18 surrounds the upper portion 46 of two-piece frame 16*a*.

Resilient band 18 may be used to seal manhole structure 10 in a variety of ways. The resilient band 18 may be placed over gaps in manhole structure 10 such as those found between the cone 14 and the adjusting rings 22, between individual adjusting rings 22, between adjusting rings 22 and the base portion 24 of frame 16, between adjusting rings 22 and the flange 44 of two-piece frame 16*a*, between the flange 44 and upper portion 46 of two-piece frame 16*a*. The resilient band 18 may also be used to provide a seal for holes (not shown) for bolts or anchors in the base portion 24 of frame 16 or flange 44 of frame 16*a*. The application of resilient band 18 can also be used to protect those portions of manhole structure 10 that do not present structural gaps, such as the upper portion 26 of frame 16 and the upper portion 46 of two-piece frame 16*a*.

When used to seal a manhole structure with frame 16, resilient band 18 is placed around the upper portion of the frame 26 and pulled down into the position shown in FIG. 2. In this embodiment, resilient band 18 is positioned around manhole structure 10 from the top of cone 14 to the upper portion 26 of manhole frame 16 so that an effective seal is formed. Resilient band 18 may also be positioned so that first portion 36 surrounds one or more adjusting rings 22 and second portion 40 surrounds the upper portion 26 of frame 16.

In the embodiment shown in FIG. 3, resilient band 18 is positioned around the top of cone 14 up to the upper portion 46 of two-piece manhole frame 16*a*.

When used to seal a manhole structure with a two-piece manhole frame 16*a*, resilient band 18 is pulled down over the upper portion of the frame 46. Optionally, either the first portion 36 or the second portion 38 or both may secured to the manhole frame 16 or 16*a* by applying an adhesive (not shown) to the inner surfaces of resilient band 18.

In an embodiment, the adhesive (not shown) is applied to resilient band 18 at the lower edge the first portion 36 and the upper edge of second portion 38. A variety of adhesives could be used to secure resilient band 18 to manhole structure 10. A butyl mastic adhesive, for example, is well-suited to secure resilient band 18 to manhole structure 10, especially when used in connection with a primer (not shown) for preparing the surfaces of the manhole structure 10 proximate the resilient band 18 to better receive the adhesive applied to the first and second portions 36 and 48 of the resilient band 18. The primer may be delivered in number of ways, including in aerosol form. The butyl mastic adhesive may be applied to the resilient band 18 before the resilient based 18 is positioned on the manhole structure 10. The primer may then be applied to the surface of manhole structure 10 so that when the resilient band 18 is positioned over manhole structure 10 the butyl mastic adhesive and the primer work together to keep the resilient band 18 in place.

The use of resilient band 18 for sealing manhole structure 10 may include the additional step of securing one or more supplemental retaining bands 42 around at least one external periphery of the resilient band 10 to form a supplemental seal. Supplemental bands 42 may be positioned over those external portions of the resilient band 18 whose internal portions have been treated with an adhesive. For example, two retaining bands 42 may be used, one around the lower edge of the first portion 36 of resilient band 18 and one around the upper edge of the second portion 38 of resilient band 18 as depicted in FIG. 2. The retaining band 42 may be chosen from those made of any material suitable for long-term exposure to moisture, such as stainless steel or plastic.

Resilient band 18 may be constructed of various polymers having the elastic properties of natural rubber. A plurality of pieces of such material may be joined together with seams to make resilient band 18. As will be appreciated by those of skill in the art, resilient band 18 could also be made from a single piece of material, without seams.

What is claimed is:

1. A resilient band for sealingly engaging a manhole structure, the manhole structure including an upper margin of a cone having a first peripheral dimension and a frame disposed above the cone, the frame having an upper and lower portion, the lower portion of the frame proximate the upper margin of the cone and the upper portion of the frame extending from the frame's lower portion and having a a second peripheral dimension smaller than the first peripheral dimension, the resilient band comprising a first and second portions and a tapered zone wherein:

the first portion presents a first sealing surface sealingly engageable and having an inner surface sized to fit around the exterior of the first peripheral dimension of the manhole structure; and the second portion with a smaller peripheral dimension than the first portion presents a second sealing surface sealingly engageable and having an inner surface sized to fit around the exterior of the second peripheral dimension of the manhole structure; and the tapered zone tapers in peripheral dimension from the larger first portion of the resilient band to the smaller second portion of the resilient band, so that when the first portion of the resilient band is sealingly engaged around the first peripheral dimension of the manhole structure and the second portion is sealingly engaged around the second peripheral dimension of the manhole structure, the resilient band defines a tapered sealing barrier around the exterior of the first peripheral dimension of the manhole structure and extending to the exterior of the second peripheral dimension of the manhole structure.

2. The resilient band of claim 1 wherein the resilient band is preformed from a plurality of pieces of material.

3. The resilient band of claim 1 wherein the resilient band is of one-piece construction, without seams.

4. The resilient band of claim 1, wherein at least one of the sealing surfaces further comprises an adhesive for sealingly securing a portion of the resilient band to at least one periphery of the manhole structure.

5. The resilient band of claim 4, wherein the adhesive is a butyl mastic.

6. The resilient band of claim 1, wherein the manhole structure includes at least one adjusting ring disposed between the cone and the frame, the first sealing surface of the first portion of the resilient band being sealingly engageable and having an inner surface sized to fit around the exterior of the at least one adjusting ring.

7. The manhole structure of claim 6 wherein the resilient band is preformed from a plurality of pieces of material.

8. The manhole structure of claim 6 wherein the resilient band is of one-piece construction, without seams.

9. The manhole structure of claim 6 wherein at least one of the first and second sealing surfaces further comprises an adhesive for sealingly securing a portion of the resilient band to at least one periphery of the manhole structure.

10. The manhole structure of claim 9 wherein the adhesive is a butyl mastic.

11. A method for sealing a manhole structure, the manhole structure including a an upper margin of a cone defining a first peripheral dimension presenting a first peripheral dimension and a frame, the frame having an upper and lower portion, the lower portion of the frame proximate the upper margin of the cone and the upper portion of the frame having a second peripheral dimension, the upper portion of the frame extending from the frame's lower portion and presenting a second peripheral dimension smaller than the first peripheral dimension, the method comprising:

providing a resilient band comprising a first portion presenting a first sealing surface sealingly engageable and having an inner surface sized to fit around the exterior of the first peripheral dimension of the manhole structure and a second portion with a smaller peripheral dimension than the first portion presenting a second sealing surface sealingly engageable and having an inner surface sized to fit around the exterior of the upper portion of the frame and a tapered zone tapering in peripheral dimension from the larger first peripheral dimension of the upper margin of the cone to the smaller second peripheral dimension of the frame; and placing the resilient band around the manhole structure so that when the first portion of the resilient band is sealingly engaged around the first peripheral dimension of the manhole structure and the second portion is sealingly engaged around the second peripheral dimension of the manhole structure, the resilient band defines a tapered sealing barrier extending from the exterior of the first peripheral dimension of the manhole structure to the exterior of the second peripheral of the manhole structure.

12. The method of claim 11 further comprising the step of securing a portion of the resilient band to the manhole structure with an adhesive.

13. The method of claim 11 wherein the step of placing the resilient band around the manhole structure further comprises positioning the first portion of the resilient band so that it is in contact with the frame and one or more adjusting rings below the manhole frame.

14. The method of claim 11 wherein the step of placing the resilient band around the manhole structure further comprises positioning the first or second portion of the band so that it is in contact with at least a portion of the cone.

15. The method of claim 11 further comprising the step of securing at least one additional band for retaining the resilient band in position on the manhole structure around the outer surface of the resilient band.

16. The method of claim 15 wherein at least one of the additional bands for retaining the resilient band forms a compression seal.

17. The method of claim 11 wherein the manhole structure includes at least one adjusting ring disposed between the cone and the frame, the first sealing surface of the first portion of the resilient band being sealingly engageable and having an inner surface sized to fit around the exterior of the at least one adjusting ring.

* * * * *